US009032675B2

(12) United States Patent
Laible et al.

(10) Patent No.: US 9,032,675 B2
(45) Date of Patent: May 19, 2015

(54) DEVICE FOR COVERING A GAP

(75) Inventors: Karl-Friedrich Laible, Langenau (DE); Hans-Philipp Reitz, Giengen (DE)

(73) Assignee: BSH BOSCH UND SIEMENS HAUSGERATE GMBH, Munich (DE)

( * ) Notice: Subject to any disclaimer, the term of this patent is extended or adjusted under 35 U.S.C. 154(b) by 569 days.

(21) Appl. No.: 12/085,642

(22) PCT Filed: Oct. 19, 2006

(86) PCT No.: PCT/EP2006/067585
§ 371 (c)(1),
(2), (4) Date: May 27, 2008

(87) PCT Pub. No.: WO2007/062917
PCT Pub. Date: Jun. 7, 2007

(65) Prior Publication Data

US 2009/0252548 A1 Oct. 8, 2009

(30) Foreign Application Priority Data

Nov. 30, 2005 (DE) ..... 10 2005 057 153

(51) Int. Cl.

| | |
|---|---|
| ***E04B 2/00*** | (2006.01) |
| ***E04F 19/02*** | (2006.01) |
| ***A47B 95/00*** | (2006.01) |
| ***F24C 15/30*** | (2006.01) |
| *A47B 96/20* | (2006.01) |
| *F25D 23/10* | (2006.01) |

(52) U.S. Cl.
CPC ..... *E04F 19/02* (2013.01); *Y10T 403/54* (2013.01); *A47B 95/002* (2013.01); *A47B 2096/208* (2013.01); *F24C 15/30* (2013.01); *F25D 23/10* (2013.01)

(58) Field of Classification Search
USPC ..... 24/293, 294, 295; 52/287.1, 288.1, 52/716.1, 718.01, 718.04; 403/329
See application file for complete search history.

(56) References Cited

U.S. PATENT DOCUMENTS

| | | | | | |
|---|---|---|---|---|---|
| 3,392,720 | A | | 7/1968 | Sherman | |
| 3,435,574 | A | * | 4/1969 | Hallock | 52/288.1 |
| 3,448,552 | A | * | 6/1969 | Schmitt et al. | 52/288.1 |
| 3,696,575 | A | * | 10/1972 | Armstrong | 52/288.1 |
| 4,067,155 | A | * | 1/1978 | Ruff et al. | 52/287.1 |
| 5,553,422 | A | * | 9/1996 | Gazaway | 52/718.04 |

FOREIGN PATENT DOCUMENTS

| | | | | |
|---|---|---|---|---|
| DE | 84 36 502 U | | 4/1986 | |
| DE | 89 08 722 U | | 4/1990 | |
| DE | 89 08 395 U | | 8/1990 | |
| DE | 43 39 093 | | 6/1994 | |
| DE | 197 36 533 | | 2/1999 | |
| DE | 298 11 701 U | | 11/1999 | |
| EP | 0 441 363 | | 8/1991 | |
| EP | 1 002 483 | | 5/2000 | |
| JP | 5-272235 | * | 10/1993 | 52/718.01 |

OTHER PUBLICATIONS

International Search Report PCT/EP2006/067585.

* cited by examiner

*Primary Examiner* — Michael P Ferguson
(74) *Attorney, Agent, or Firm* — Nixon & Vanderhye P.C.

(57) ABSTRACT

A device for covering a gap between a housing of a household appliance and a surface which is adjacent thereto. Said device comprises two profile elements, a first for securing to the surface and the second for securing to the housing. One of the profile elements comprises a groove and the other comprises a spring. The spring can be introduced into the direction of the width of the gap in the groove.

6 Claims, 2 Drawing Sheets

DEVICE FOR COVERING A GAP

This application is a U.S. National Phase of International Application No. PCT/EP2006/067585, filed Oct. 19, 2006, which designates the U.S. and claims priority to German Application No. 102005057153.0, filed Nov. 30, 2005, the entire contents of each are hereby incorporated by reference.

BACKGROUND OF THE INVENTION

The present invention relates to a device for covering a gap between a housing of a domestic appliance and a surface which is adjacent thereto.

In order to create a join with a uniform appearance between domestic appliances and cabinets in a kitchen, it is common practice to introduce built-in domestic appliances into niches of kitchen furniture in each instance and to screen them with a furniture panel, which has the same design features as adjacent cabinet doors. Noticeable gaps between the device and adjacent items of furniture can be avoided since the furniture niches have predefined grid dimensions to which the dimensions of the built-in device and its front panel are adapted.

If a household appliance of a freestanding design is to be installed in an intermediate space between existing furniture or devices or for instance under a suspended cabinet, it cannot be assumed that this intermediate space has grid dimensions. Instead, gaps which may have different widths occur between the domestic appliance and the adjacent furniture or devices. These gaps negatively affect the appearance and are also troublesome for daily use, since objects and dirt can enter therein and can only be removed again with effort.

BRIEF SUMMARY OF THE INVENTION

The object of the invention is to specify a device for covering a gap between a housing of a domestic appliance and a surface which is adjacent thereto, with it being possible to easily assemble said device, which consists of a small number of parts and can be easily adjusted to gaps of different widths.

The object is achieved by a device for covering a gap between a housing of a domestic appliance and a surface which is adjacent thereto, having two profile elements, a first of which is configured for securing to the surface and the second for securing to the housing, wherein one of the profile elements comprises a groove and the other a spring, and the spring can be introduced in the direction of the width of the gap into the groove. An adjustment to different gap widths is possible by allowing the spring to penetrate into the groove to varying degrees depending on the gap width during assembly without different models of the profile elements having to be provided herefor.

Particularly extensive adjustability to different gap widths can be achieved as a result if the spring has successive weak points in the insertion direction, at which it can be shortened by e.g. breaking or cutting off.

These weak points are preferably narrow channels. These do not merely determine a preset breaking point or guide a cutting tool, but simultaneously allow for improved coherence between the spring and groove by means of locking mechanism.

In order to eliminate or at least reduce the ability of the domestic appliance to move in relation to the surface, the device also preferably comprises a deformable coupling part to be secured to the housing and the surface and thereby bridging the gap.

The coupling part comprises a preferably first plate for securing to the housing, a second plate for securing to the surface as well as an intermediate piece which is flexibly connected to both panels. Such a coupling part can be attached in gaps of various widths on account of its flexibility. In particular, in the case of a horizontal gap between the housing and furniture unit permanently mounted thereabove, like a suspended cabinet, it is nevertheless sufficient to secure the housing in respect of the furniture.

To this end, the second panel of the coupling part can also serve to clamp the first profile element to the surface.

A lug is advantageously formed on a main surface of the second panel, through which extends a screw hole for screwing onto the surface. While the lug comes into contact with the surface of the furniture while being screwed thereonto, a gap remains between the parts of the main surface of the second panel and of the surface of the furniture which surround the lug, into which gap the first profile element can still be inserted if the coupling part is already secured to the surface of the furniture.

In order to make such a subsequent insertion easier, a leg of the first profile element preferably has an open-edged slot which is dimensioned so as to receive the lug of the second panel.

The second profile element is preferably fixed to the sides of the housing by insertion into a gap which is delimited on one hand by the housing itself and on the other hand by the first panel of the coupling part.

BRIEF DESCRIPTION OF THE DRAWINGS

Further features and advantages of the invention emerge from the description which follows of exemplary embodiments with reference to the accompanying figures, in which.

DETAILED DESCRIPTION OF THE PRESENT INVENTION

Figure 1:
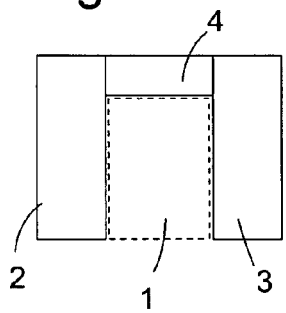
FIG. 1 shows an example of a built-in configuration of a domestic appliance between adjacent furniture, in which the inventive covering device can be used.

In the configuration shown in FIG. 1, a domestic appliance 1 is inserted into an intermediate space which is delimited on the right and left by pieces of furniture 2, 3 which are higher than device 1, and is delimited in the upward direction by a suspended cabinet 4. In order to hold the position of the device 1 permanently upright, during which the front panel of the device 1 is correctly aligned in respect of the furniture 2, 3, 4 adjacent thereto, it is important to fix the device 1 in the intermediate space in respect of the furniture. Gaps between the device 1 and the furniture 2, 3, 4, in which a coupling part could be mounted for this purpose, are nevertheless inaccessible provided the device 1 is positioned in the intermediate space.

Figure 2:
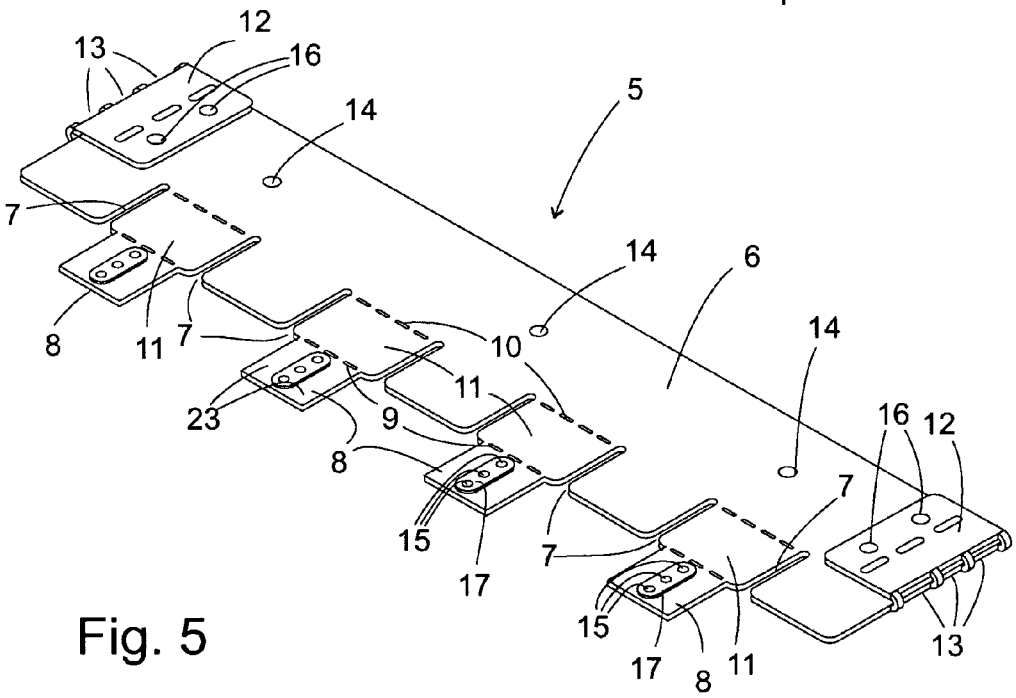
FIG. 2 shows a perspective view of a coupling part used to couple the domestic appliance with adjacent furniture.

FIG. 2 shows a perspective view of a coupling part which, if it is mounted on the domestic appliance 1 before the latter is inserted into the intermediate space, allows the device to be coupled to the adjacent furniture after insertion and alignment.

The coupling part 5 punched out of sheet metal in a single piece comprises an essentially rectangular base plate 6, the width of which corresponds to that of the domestic appliance 1. Mounting tabs 8 protrude beyond a front edge of the base plate 6 at equal distances from one another. Slots 7 are cut into the base plate 6 on both sides of each mounting tab 8. Groups 9, 10 of slotted holes are punched out along the front edge of the base plate 6 as well as between the ends of two slots 7 which are adjacent to one another in each instance. The slots 7 and the groups of slotted holes 9, 10 each delimit intermediate pieces 11 which are easily bendable along the groups 9, 10, both in respect of the mounting tabs 8 and in respect of the remainder of the base plate 6.

Further mounting tabs 12 are formed on the longitudinal ends of the base plate 6 and are likewise displaced from these by groups of slotted holes 13. In the configuration shown in FIG. 2, the mounting tabs 12 are each bent back along the slotted holes 13 on the upper side of the base plate 6.

A hinge connection, e.g. of the piano hinge type, may also be considered as an alternative to the one-piece connection between the base plate 6 and the lateral mounting tabs 12 shown in the Fig.

Holes 14 in the base plate 6 are used to screw the coupling part 5 to the body of the domestic appliance 1, provided holes 15, 16 in the mounting tabs 8, 12 used to screw the tabs to adjacent furniture 2, 3, 4 are available. The mounting tabs 8 each have an elongated lug 17 facing upwards, in which the holes 15 are formed.

Figure 3:
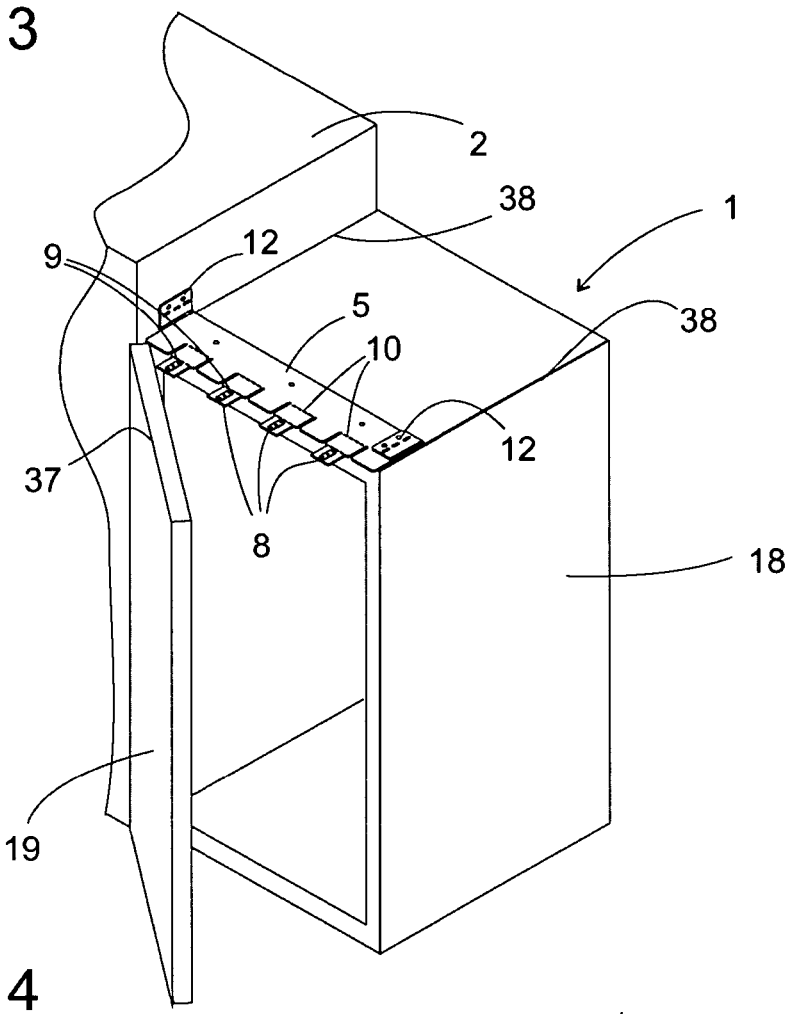
FIG. 3 shows a perspective view of the domestic appliance with a coupling part assembled on the body and coupled to an adjacent furniture unit.

The coupling part 5 can be used in various installation configurations. FIG. 3 thus shows a configuration which differs from that of FIG. 1, with the domestic appliance 1, a furniture unit 2 installed to the left (when viewed from the front) of the domestic appliance 1 as well as the coupling plate 5. The suspended cabinet 4 is not present, so that the upper side of the domestic appliance 1 is accessible after its positioning. The domestic appliance has a body 18 and a door 19 attached thereto, shown partly open in the figure. The coupling part 5 is screwed onto the upper side of the body 18 in a position in which the front edge of the base plate 6 coincides with the upper front edge of the body 18. The mounting tabs 8 are disposed at the same level as the base plate 6 and overlap the front side of the body 18, however not so far that they would also overlap the front edge 37 of the door 19 when the latter is closed. The base plate 6 extends from one side edge 38 of the upper side of the body 18 to the other.

One of the lateral mounting tabs 12 is rotated upwards by 90° about an axis which essentially coincides with the adjacent edge 38, so that the mounting tab 12 rests against the side wall of the furniture unit 2, and is screwed hereonto so that it fixes the domestic appliance 1 in a position in relation to the furniture unit 2, in which the door 19, when closed, is aligned flush with the front side of the furniture unit 2 or is otherwise aligned as desired.

In order to couple the domestic appliance 1 to a furniture unit which has the same height as itself, one of the lateral mounting tabs 12 can be rotated by 180° from the position shown in FIG. 2 into a horizontal position which laterally overlaps the body 18, a position in which it is located on the upper side of the furniture unit and can be screwed into this from above.

If no furniture unit is mounted above the domestic appliance 1, as shown in FIG. 3, it is possible to pivot the forward-overlapping mounting tabs 8 back along each of the slotted holes 9 or 10, so that the tabs 8 come to rest on the base plate 6 and are then practically no longer visible from the front when the door 19 is open.

Figure 4:
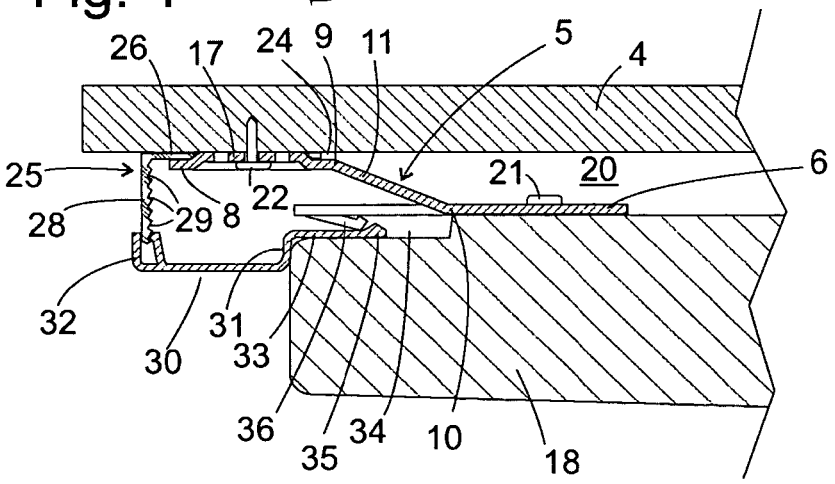
FIG. 4 shows a vertical section through the coupling part and the element of the domestic appliance which are adjacent thereto and a suspended cabinet assembled thereabove in the built-in configuration as per FIG. 1.

The use of the tabs 8 for coupling the device 1 to a suspended cabinet 4 arranged thereabove is shown in FIG. 4 by means of a vertical section, which shows the coupling part 5 as well as a piece of the cover of the body 18 and of the base of the suspended cabinet 4 in each instance. A gap 20 is disposed between both, the width of which can be different in every positioning instance. Before insertion of the device under the suspended cabinet 4, the coupling part 5 is fixed to the body 18 using screws 21. The mounting tabs 8 are pushed out of this position against the base plate of the cabinet 4, wherein the material of the coupling part 5 flexes along the groups of slotted holes 9, 10 and the intermediate piece 11 adopts the diagonal course shown in the figure. The lug 17 of the tab 8 is held compressed against the cabinet 4 by means of a screw 22.

Figure 5:
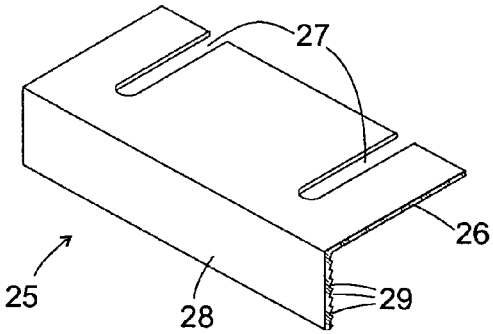
FIG. 5 shows a perspective view of a profile element.

Areas 23 surrounding the lug 17 (see FIG. 2) thereby remain separated from the underside of the cabinet 4 by means of a narrow gap 24. A first cover profile 25 is inserted into this gap. FIG. 5 shows a perspective view of a section of this first cover profile 25. It has an essentially L-shaped cross-section with a horizontal leg 26, into which open-edged slots 27 are cut at regular intervals. These slots 27 allow the horizontal leg 26 to be inserted into the gap 24 by receiving the lugs 17 of the tabs 8 screwed onto the cabinet 4 in each instance. A vertical leg 28 covers the view from the front of the gap 20 and the coupling part 5 mounted thereupon.

The vertical leg 28 is provided with a plurality of horizontally-extending narrow channels 29 on its rear side facing the body 18. These narrow channels 29 form weak points along which it is easily possible to shorten the leg 28 by cutting or breaking and thus to adjust it to the width of the gap 20.

Since the mounting tabs 8 must protrude beyond the front side of the body 18, in order to be able to screw them onto the underside of the cabinet 4, the vertical leg 28 of the cover profile 25 cannot touch the body 18 and therefore cannot completely close off the gap 20. A second cover profile 30, which is embodied here as an extruded section of the consistent cross-section in the form of a flat channel with side walls 31, 32, is used for this purpose. One of the side walls 31 rests against the front side of the body 18, and the other 32 contains a groove which opens upwards, into which the vertical leg 28 engages. In this way the fluted rear side of the leg 28 allows the leg 28 to lock into the groove.

A web 33 protrudes horizontally from the side wall 31 and engages into a gap 34 between the upper side of the body 18 and the base plate 6. A bulge 35 on the free end of the web 33 is locked onto stop notch plates 36 notched out of the base plate 6.

After securing the tab 8 to the suspended cabinet 4, these two cover profiles 25, 30 provide for a complete lamination of the gap 20 with two manual operations, by inserting the profile 25 into the gap 24 surrounding the lugs 17 of the tabs 8, and subsequently inserting the cover profile 30 into the gap 34 and attaching it onto the vertical leg 28.

It is also easily imaginable without the need for graphical illustration that profile elements like the cover profiles 25, 30 can also be provided in a gap between the domestic appliance 1 and the laterally adjacent furniture 2, 3 in order to cover these.

The invention claimed is:

1. A device for covering a gap between a housing of a domestic appliance and a first surface which is adjacent to and separate from the housing, the device comprising:

a first profile element with a first leg and a second leg configured to be secured to the first surface, wherein the first leg is adapted to be substantially perpendicular to the first surface and the first leg is adapted to be disposed remote from the housing with respect to the rest of the first profile element;

a second profile element with a third leg and a first receptacle, wherein the first receptacle is adapted to receive the first leg; and a spanning element adapted to span the gap and including a second plate adapted to be secured to the first surface to form a second receptacle therebetween and including a first plate adapted to be secured to the housing of the domestic appliance to form a third receptacle therebetween, each of the second and third receptacles for separately receiving one of the second leg and the third leg, wherein the first profile element and the second profile element together are adapted to span the gap when the first leg is received in the first receptacle, wherein the spanning element is adapted to deform at one or more predetermined locations to span different sizes of the gap.

2. The device according to claim 1, wherein the spanning element is adapted to deform along two predetermined lines that are substantially parallel to one another.

3. A device for covering a gap between a housing of a domestic appliance and a first surface which is adjacent to and separate from the housing, the device comprising:

a first profile element with a first leg and a second leg configured to be secured to the first surface, wherein the first leg is adapted to be substantially perpendicular to the first surface and the first leg is adapted to be disposed remote from the housing with respect to the rest of the first profile element;

a second profile element with a third leg and a first receptacle, wherein the first receptacle is adapted to receive the first leg; and a spanning element adapted to span the gap and including a second plate adapted to be secured to the first surface to form a second receptacle therebetween and including a first plate adapted to be secured to the housing of the domestic appliance to form a third receptacle therebetween, each of the second and third receptacles for separately receiving one of the second leg and the third leg, wherein the first profile element and the second profile element together are adapted to span the gap when the first leg is received in the first receptacle, wherein the first leg is substantially perpendicular to the second leg.

4. The device according to claim 3, wherein the second leg and the third leg are adapted to be substantially parallel when received by the second receptacle and the third receptacle.

5. A device for covering a gap between a housing of a domestic appliance and a first surface which is adjacent to and separate from the housing, the device comprising:

a first profile element with a first leg and a second leg configured to be secured to the first surface, wherein the first leg is adapted to be substantially perpendicular to the first surface and the first leg is adapted to be disposed remote from the housing with respect to the rest of the first profile element;

a second profile element with a third leg and a first receptacle, wherein the first receptacle is adapted to receive the first leg; and a spanning element adapted to span the gap and including a second plate adapted to be secured to the first surface to form a second receptacle therebetween and including a first plate adapted to be secured to the housing of the domestic appliance to form a third receptacle therebetween, each of the second and third receptacles for separately receiving one of the second leg and the third leg, wherein the first profile element and the second profile element together are adapted to span the gap when the first leg is received in the first receptacle, wherein the spanning element is adapted to be at least partially within the gap and the first profile element and the second profile element are adapted to obscure the spanning element when viewed from a front of the domestic appliance.

6. A device for covering a gap between a housing of a domestic appliance and a first surface which is adjacent to and separate from the housing, the device comprising:

a first profile element with a first leg and a second leg configured to be secured to the first surface, wherein the first leg is adapted to be substantially perpendicular to the first surface and the first leg is adapted to be disposed remote from the housing with respect to the rest of the first profile element;

a second profile element with a third leg and a first receptacle, wherein the first receptacle is adapted to receive the first leg; and a spanning element adapted to span the gap and including a second plate adapted to be secured to the first surface to form a second receptacle therebetween and including a first plate adapted to be secured to the housing of the domestic appliance to form a third receptacle therebetween, each of the second and third receptacles for separately receiving one of the second leg and the third leg, wherein the first profile element and the second profile element together are adapted to span the gap when the first leg is received in the first receptacle, wherein the first surface is not part of the domestic appliance.

* * * * *